United States Patent [19]

Parsons et al.

[11] 4,318,348

[45] Mar. 9, 1982

[54] RAILROAD TANK CAR

[75] Inventors: James D. Parsons, Ridgefield, Wash.; Paul S. Wike, Chicago, Ill.

[73] Assignee: Union Tank Car Company, Chicago, Ill.

[21] Appl. No.: 116,337

[22] Filed: Jan. 28, 1980

Related U.S. Application Data

[62] Division of Ser. No. 932,817, Aug. 10, 1978, Pat. No. 4,210,254.

[51] Int. Cl.[3] ..... B65D 41/16; B65D 51/16

[52] U.S. Cl. ..... 105/358; 73/298; 220/85 B; 220/327; 222/386.5

[58] Field of Search ..... 105/358, 359, 360, 3; 215/224, 301, 307, 310, 317; 220/85 B, 281, 292, 303, 360, 327, 366, 22, 20; 222/154, 156, 386.5; 73/298

[56] References Cited

U.S. PATENT DOCUMENTS

| | | | |
|---|---|---|---|
| 1,384,915 | 7/1921 | Parks | 220/327 |
| 1,827,574 | 10/1931 | Frazier | 73/298 |
| 2,984,392 | 5/1961 | Wajenby | 222/386.5 |
| 3,005,317 | 10/1961 | Bunn | 220/85 B |
| 3,141,008 | 7/1964 | Flick et al. | 220/327 |
| 3,351,235 | 11/1967 | Paton | 220/22 |
| 4,135,635 | 1/1979 | Fujii et al. | 220/85 B |

FOREIGN PATENT DOCUMENTS

| | | | |
|---|---|---|---|
| 2247901 | 12/1973 | France | 220/85 B |

*Primary Examiner*—Richard A. Bertsch

*Attorney, Agent, or Firm*—Dressler, Goldsmith, Shore, Sutker & Milnamow, Ltd.

[57] ABSTRACT

A flexible diaphragm can be moved to line opposite surfaces of a tank vehicle so that incompatible fluids alternately can be transported in the vehicle without the need for cleaning it. The diaphragm is prevented from entering a manway on the vehicle, and an outage gauge is confined entirely within the manway to prevent damage to the diaphragm.

9 Claims, 3 Drawing Figures

RAILROAD TANK CAR

RELATED INVENTIONS

This application is a division of United States application for Letters Patent Ser. No. 932,817, filed Aug. 10, 1978, now U.S. Pat. No. 4,210,254, which is assigned to the same assignee as this invention.

BACKGROUND OF THE INVENTION

This invention relates to wheeled vehicles, and more particularly to railroad tank cars for transporting different liquids in a given container.

When a tank truck or a railroad tank car transporting a particular gas or liquid is to be used to transport a different non-compatible fluid, it is necessary to clean the container of the vehicle. This is usually expensive and inconvenient, and the required specialized cleaning facilities frequently are not available. To solve this problem, it has been proposed that vehicles for transporting fluids be provided with a pair of separate inlets and outlets and a flexible diaphragm that alternately lines opposed sides of the vehicle's container. Movement of the diaphragm to line one side of the container provides a chamber for one fluid, and movement of the diaphragm to the opposite side of the container provides a chamber for a different non-compatible fluid. Thus, the container does not have to be cleaned to enable the vehicle to transport either of such fluids. However, there has not been any significant use of such vehicles having a diaphragm that enables them to alternately carry non-compatible fluids without being cleaned in between. One reason such vehicles have not been used has been the extensive modification of standard vehicles believed necessary to prevent damage to the diaphragm or to the vehicle container or components. For example, it is necessary that liquid transport vehicles have a specified minimum empty space or outage in their upper end. A visible gauge that projects into the vehicle tank has been used to identify the uppermost permissible liquid level in the tank. Such a gauge could not be used in a diaphragm vehicle because it could damage, or be damaged by, the diaphragm.

OBJECTIVES OF THE INVENTION

Accordingly it is an object of this invention to provide improved means for transporting non-compatible fluids.

Another object is to protect a flexible diaphragm from damage by the components of a vehicle for transporting liquids.

Another object is to provide an outage sight gauge which cannot touch a flexible diaphragm that defines different liquid chambers in a transport vehicle.

Another object is to support a flexible diaphragm in a mansized hole in a liquid transporting vehicle.

Another object is to prevent an outage sight gauge from damaging a flexible diaphragm in a liquid transportation vehicle.

Another object is to provide a relatively inexpensive, durable, easily maintained railroad tank car having a flexible diaphragm in its container that does not possess defects found in similar prior art tank cars.

Other objects and advantages will be found in the specifications and claims, and the scope of the invention will be pointed out in the claims.

DESCRIPTION OF THE INVENTION

Figure 1:
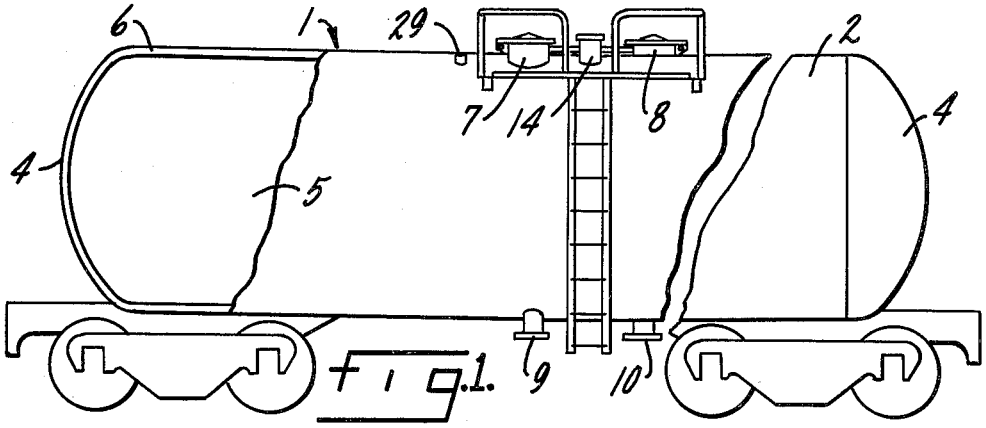
FIG. 1 is a schematic, partially broken-away side view of a railroad tank car in accord with this invention.
Figure 2:
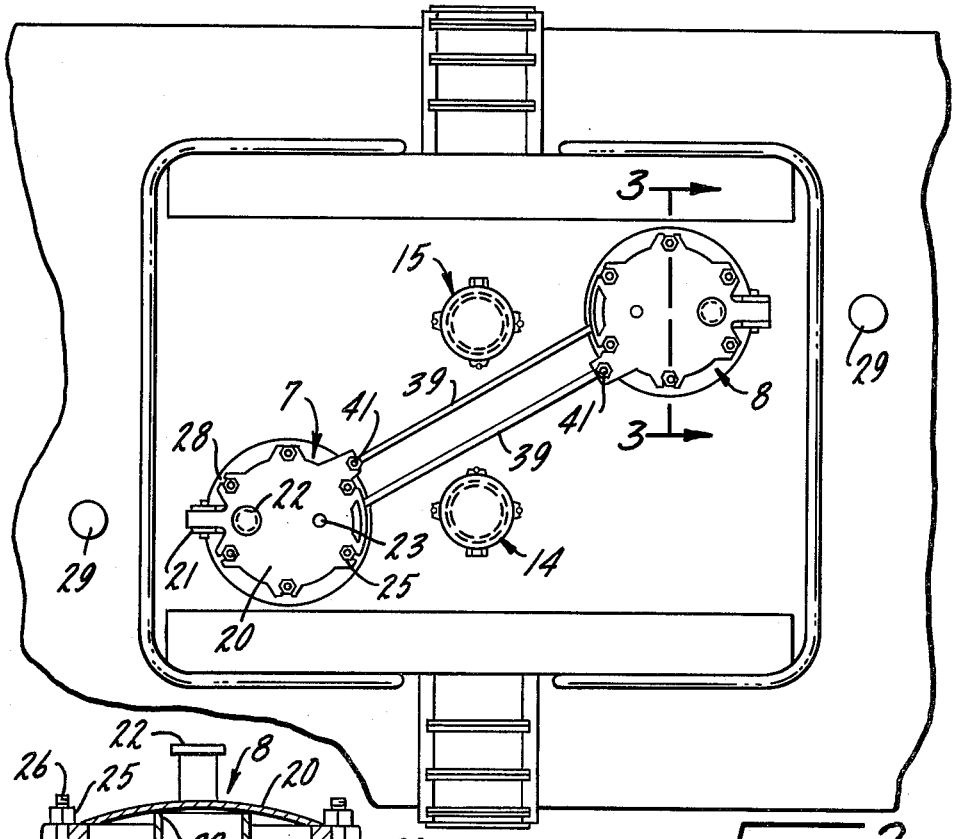
FIG. 2 is an enlarged partial top view of the car shown in FIG. 1.
Figure 3:
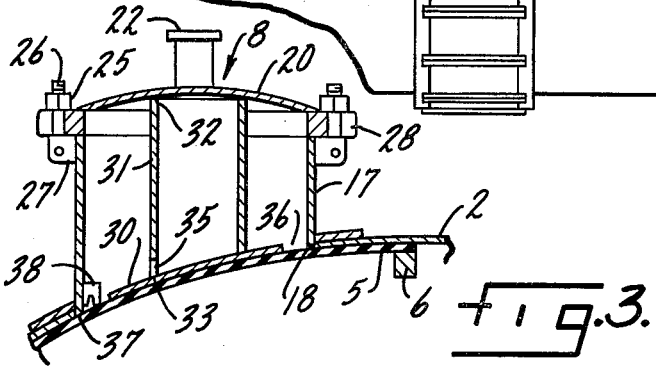
FIG. 3 is a cross sectional view taken along the line 3—3 in FIG. 2.

The drawing shows a railroad tank car 1 including a metal tank 2 for containing and transporting alternately two different non-compatible liquids, such as lube oil and diesel oil. Container tank 2 is generally cylindrical, and has a generally horizontal longitudinal axis; its ends are closed by dished heads 4. Tank 2 encloses a diaphragm 5 made from a flexible material having its terminal edge clamped at 6 or otherwise sealed against the inside surface of tank 2 around its entire periphery in a generally vertical plane which generally bisects tank 2 longitudinally. A pair of manways 7 and 8 are located adjacent the upper surface of tank 2 on opposite sides of its longitudinal center, and a pair of conventional liquid outlets 9 and 10 are located adjacent the lower surface of tank 2 on opposite sides of its longitudinal center. A pair of quick-fill nozzles 14 and 15 are also located adjacent the upper surface of tank 2 on opposite sides of its longitudinal center. Nozzles 14 and 15 and manways 7 and 8 provide pairs of upwardly extending liquid inlet conduits, each such pair providing an inlet conduit on each side of the plane of the edge of diaphragm 5. Car 1 should be provided with other necessary conventional components and accessories, such as trucks, draft gear, ladders and platforms, which do not form part of the present invention.

When tank 2 is filled with a specific liquid through nozzle 14 or manway 7, diaphragm 5 will lie against the inside wall surface of tank 2 and define a chamber for such liquid; such liquid would be drained through outlet 9. When tank 2 is filled with a non-compatible liquid through nozzle 15 or manway 8, diaphragm 5 will be against the inside wall surface of tank 2 and define a different chamber for the non-compatible liquid; this liquid would be drained through outlet 10. The separate chambers for non-compatible liquids are hermetically isolated, so it is not necessary to clean tank 2 whenever car 1 carries either of such liquids.

Each manway 7 and 8 is made from an upstanding open-ended cylindrical ring 17 welded to the upper portion of tank 2 around a man-sized hole 18 through the tank. The rings 17 are located outside of and on opposite sides of the plane of the terminal edge of diaphragm 5. A manway cover or lid 20 is pivotally attached to each ring 17 by a hinge 21 for closing the upper open end of the ring. Each lid 20 includes a vacuum relief valve 22 and an air connection 23 of conventional design. Lids 20 may be sealed against the top of rings 17 by nuts 25 threaded on to six bolts 26 attached to hinges 27 on rings 17 and pivotable in conventional manner into slots 28 in lids 20. Conventional pressure relief valves 29 are mounted on tank 2 adjacent the terminal edges of diaphragm 5.

Man-sized hole 18 defines a relatively large area (e.g. two sq. ft.) in which the inside wall of tank 2 cannot support diaphragm 5. Substantial gas or liquid pressures may occur in tank 2 which could force diaphragm 5 through hole 18; this could force diaphragm 5 against components in one of the manways or against the edge of a hole 18 with sufficient force to cut or tear the diaphragm. Baffle means such as plate 30 is shaped to conform to the curvature of the wall of tank 2. When lid 20 is closed, baffle plate 30 is located in hole 18 so as to define essentially a continuation of the inside surface of the tank wall that provides means for supporting diaphragm 5 and thereby preventing the diaphragm from being forced through hole 18 by pressure in the tank. A cylindrical tubular member 31 extends through ring 17 and has its upper end 32 attached to the underside of lid 20. The lower end 33 of tubular member 31 is attached to the center portion of baffle 30. One or more vent holes 35 are provided in tube 31 at end 33 to permit drainage of liquid or condensation. The annular space 36 separating the edge of baffle 30 from the edge of hole 18 is sufficient to permit lid 20 to swing open without baffle 30 binding against ring 17 but is insufficient to permit diaphragm 5 to enter hole 18.

The vertically lowermost portion or edge 37 of each ring 17 is spaced below the top surface of tank 2 a predetermined vertical distance (e.g. four inches) sufficient to define adequate outage space in the top of the chamber on each side of diaphragm 5 for the liquid tank 2. An outage sight gauge 38 is located entirely within each ring 17 adjacent edge 37. Gauge 38 may be a brightly colored metal bar or other object that is visible in a manway when in contact with a liquid, and no part of gauge 38 need project below hole 18. Baffle 30 prevents diaphragm 5 from entering hole 18, so the diaphragm cannot contact gauge 38.

When the chamber defined by one side of diaphragm 5 is filled with liquid, it is necessary that the chamber defined by the other side of the diaphragm be vented to the atmosphere. This permits escape of air or vapor from the vented chamber as diaphragm 5 moves against the inside wall surface of tank 2 that had previously defined such vented chamber. Each of manways 7 and 8 may have a vent line 39 connecting a vent port (not shown) on the inside of its ring 17 to a vertical vent pipe at 41. Thus, the chambers on both sides of diaphragm 5 may be vented to the atmosphere whenever either chamber is filled through a manway.

It has thus been shown that by the practice of this invention extensive modification of a railroad tank car 1 is not necessary to permit use of a flexible diaphragm 5 for providing separate chambers for non-compatible fluids. A baffle plate 30 in each of manways 7 and 8 prevents excess pressure or pressure surges from forcing the diaphragm through hole 18, and the location of the lower edge 37 of each manway far enough below the top surface of tank 2 permits the outage sight gauge 38 to be confined entirely within each ring 17 where the diaphragm cannot touch them.

While the present invention has been described with reference to a particular embodiment, it is not intended to illustrate or describe herein all of the equivalent forms or ramifications thereof. Also, the words used are words of description rather than limitation, and various changes may be made without departing from the spirit or scope of the invention disclosed therein. It is intended that the appended claims cover all such changes as fall within the true spirit and scope of the invention.

What is claimed is:

1. A wheeled vehicle for transporting a plurality of non-compatible liquids, comprising:

A. a container for such liquids comprising a generally cylindrical tank having a generally horizontal longitudinal axis;

B. a flexible diaphragm in said tank, the periphery of said diaphragm contacting the wall of said tank in a generally vertical plane which generally bisects said tank, said diaphragm alternately lying against opposite portions of said tank so as to define different chambers for such non-compatible liquids;

C. means for sealing said diaphragm against said wall; and

D. A separate manway for each of said chambers, each manway comprising:

1. a generally circular open-ended ring attached to said tank around a man-sized hole through said wall, said ring being located entirely outside of said plane;
2. a movable lid closing said open end of said ring, said lid being pivotally attached at one end to said ring; and
3. baffle means attached to and movable with said pivoted lid and extending downwardly therefrom through said ring into said man-sized hole for supporting said diaphragm and thereby preventing said diaphragm from being forced up into said man-sized hole by pressure in said tank.

2. The invention defined in claim 1, wherein said baffle means is located in said man-sized hole and has its edge separated from the edge of said man-sized hole by an annular space sufficient to permit said lid to pivot open without causing said baffle means to bind against said ring, and said annular space being insufficient to permit said diaphragm to enter said man-sized hole.

3. The invention defined in claim 2, wherein said baffle means comprises a plate shaped to conform to the curvature of said tank wall, said baffle plate being located in said hole to define essentially a continuation of the inside surface of said tank wall when said lid is closed.

4. The invention defined in claim 2, wherein said baffle means is attached to said lid by a tubular member extending through said ring.

5. The invention defined in claim 4, wherein the upper end of said tubular member is attached to the underside of said lid, and the lower end of said tubular member is attached to the center portion of said baffle means.

6. The invention defined in claim 5, wherein said tubular member has a vent hole adjacent its lower most edge for drainage of liquid and condensation from the inside of said tubular member into said container.

7. The invention defined in claim 6, further comprising an outage gauge located entirely within said ring adjacent the lowest portion of said ring, said gauge being visible from said manway when in contact with said liquid without ever being contacted by said diaphragm.

8. A railroad tank car for transporting a plurality of non-compatible liquids, comprising:

A. a container for such liquids comprising a generally cylindrical tank having a generally horizontal longitudinal axis;

B. a flexible diaphragm in said tank, the periphery of said diaphragm contacting the wall of said tank in a generally vertical plane which generally bisects said tank, said diaphragm alternately lying against opposite portions of said tank so as to define different chambers for such noncompatible liquids;

C. means for sealing said diaphragm against said wall; and

D. a separate manway for each of said chambers, each manway comprising:

1. a cylindrical open-ended ring attached to said tank around a man-sized hole through said wall, said ring being located entirely outside of said plane;
2. a lid pivotably attached to said ring for closing said open end of said ring; and
3. means in said man-sized hole for supporting said diaphragm and thereby preventing said diaphragm from being forced up into said man-sized hole by pressure in said tank comprising:
   a. a cylindrical tube extending downwardly through said ring and having one end attached to the center portion of the underside of said lid;
   b. a baffle plate attached to the other end of said tube and occupying said hole when said lid is closed, said baffle plate being shaped to conform to the curvature of said tank wall and defining essentially a continuation of the inside surface of said tank wall, there being an annular space separating the edge of said baffle plate from the edge of said man-sized hole, said annular space being sufficient to permit said lid to pivot open without causing said baffle plate to bind against said ring, and said annular space being insufficient to permit said diaphragm to enter said man-sized hole.

9. The invention defined in claim 8, further comprising an outage gauge located in said annular space between said baffle plate and the lowest portion of said ring entirely within said ring, said gauge being visible from said manway when in contact with said liquid without ever being contacted by said diaphragm.

* * * * *